US009702556B2

(12) United States Patent
Kasahara

(10) Patent No.: US 9,702,556 B2
(45) Date of Patent: Jul. 11, 2017

(54) GLOW PLUG

(71) Applicant: NGK SPARK PLUG CO., LTD., Nagoya-shi, Aichi (JP)

(72) Inventor: Keisuke Kasahara, Nagoya (JP)

(73) Assignee: NGK SPARK PLUG CO., LTD., Aichi (JP)

( * ) Notice: Subject to any disclaimer, the term of this patent is extended or adjusted under 35 U.S.C. 154(b) by 372 days.

(21) Appl. No.: 14/372,587

(22) PCT Filed: Apr. 10, 2013

(86) PCT No.: PCT/JP2013/002422
§ 371 (c)(1),
(2) Date: Jul. 16, 2014

(87) PCT Pub. No.: WO2013/157223
PCT Pub. Date: Oct. 24, 2013

(65) Prior Publication Data

US 2014/0361005 A1 Dec. 11, 2014

(30) Foreign Application Priority Data

Apr. 16, 2012 (JP) ..... 2012-092851

(51) Int. Cl.
*F23Q 7/00* (2006.01)
*H05B 3/18* (2006.01)
*H05B 3/48* (2006.01)

(52) U.S. Cl.
CPC ..... *F23Q 7/001* (2013.01); *H05B 3/48* (2013.01); *H05B 2203/027* (2013.01)

(58) Field of Classification Search
USPC ..... 219/270
See application file for complete search history.

(56) References Cited

U.S. PATENT DOCUMENTS 4,423,309 A * 12/1983 Murphy ..... F23Q 7/001 123/145 A
4,549,071 A * 10/1985 Hatanaka ..... F23Q 7/001 123/145 A (Continued)

FOREIGN PATENT DOCUMENTS

EP 0392181 A1 10/1990
EP 1471307 A1 10/2004

(Continued)

OTHER PUBLICATIONS

Communication dated Nov. 3, 2015 from the European Patent Office in counterpart European Application No. 13778105.0.

(Continued)

*Primary Examiner* — Joseph M Pelham
(74) *Attorney, Agent, or Firm* — Sughrue Mion, PLLC

(57) ABSTRACT

A glow plug including a coil housed in a tube. The coil includes a heating coil made of an Ni—Cr alloy disposed on a front end side, and a control coil connected to a rear end side of the heating coil. The coil has a normal temperature resistance value of 300 mΩ to 500 mΩ. The accumulated amount of heat generated by the heating coil for two seconds from the start of energization is 400 joules or less. The ratio of an inrush current value at the start of energization to a current value two seconds after the start of energization is 1.2 or higher. The control coil has a temperature resistance coefficient of five or higher and a resistance value of 25 mΩ or higher at a portion between a front end of the control coil and L/2, where L is the length of the control coil.

4 Claims, 3 Drawing Sheets

(56) References Cited

U.S. PATENT DOCUMENTS

| | | | | |
|---|---|---|---|---|
| 5,091,631 | A | 2/1992 | Dupuis et al. | |
| 5,132,516 | A * | 7/1992 | Hatanaka | F23Q 7/001 123/145 A |
| 5,206,483 | A * | 4/1993 | Aota | F23Q 7/001 123/145 A |
| 5,521,356 | A * | 5/1996 | Bauer | F23Q 7/001 123/145 A |
| 6,037,568 | A * | 3/2000 | Hatanaka | F23Q 7/001 219/260 |
| 6,064,039 | A | 5/2000 | Kumada | |
| 7,705,273 | B2 | 4/2010 | Hotta et al. | |
| 2002/0023910 | A1* | 2/2002 | Kasimirski | F23Q 7/001 219/270 |
| 2002/0060214 | A1* | 5/2002 | Chiba | F23Q 7/001 219/270 |
| 2004/0084436 | A1* | 5/2004 | Reissner | F23Q 7/001 219/260 |
| 2004/0118828 | A1* | 6/2004 | Toedter | F02P 19/025 219/270 |
| 2004/0173595 | A1* | 9/2004 | Kumada | F23Q 7/001 219/270 |
| 2004/0222207 | A1 | 11/2004 | Kumada | |
| 2005/0194369 | A1* | 9/2005 | Reissner | F23Q 7/001 219/270 |
| 2006/0049163 | A1* | 3/2006 | Gotoh | F23Q 7/001 219/270 |
| 2007/0210053 | A1 | 9/2007 | Hotta et al. | |
| 2008/0149613 | A1 | 6/2008 | Ishinada | |
| 2009/0308362 | A1* | 12/2009 | Schneider | F02M 31/125 123/557 |
| 2011/0180525 | A1* | 7/2011 | Vedel | F23Q 7/001 219/270 |
| 2014/0000353 | A1* | 1/2014 | Nishiyuki | G01M 15/08 73/114.19 |
| 2014/0339214 | A1* | 11/2014 | Ruthmann | F23Q 7/001 219/270 |
| 2015/0075473 | A1* | 3/2015 | Osawa | F02P 19/021 123/145 A |
| 2015/0076136 | A1* | 3/2015 | Hatta | F23Q 7/001 219/526 |

FOREIGN PATENT DOCUMENTS

| | | | |
|---|---|---|---|
| EP | 2 587 156 | A1 | 5/2013 |
| JP | 2004-340562 | A | 12/2004 |
| JP | 2005-61828 | A | 3/2005 |
| JP | 2005-300046 | A | 10/2005 |
| JP | 2008-157485 | A | 7/2008 |
| JP | 2011-32944 | A | 2/2011 |
| WO | 99/27302 | A1 | 6/1999 |
| WO | 2011/162074 | A1 | 12/2011 |

OTHER PUBLICATIONS

International Search Report for PCT/JP2013/002422 dated Jul. 16, 2013 (PCT/ISA/210).

* cited by examiner

GLOW PLUG

CROSS REFERENCE TO RELATED APPLICATIONS

This application is a National Stage of International Application No. PCT/JP2013/002422 filed Apr. 10, 2013, claiming priority based on Japanese Patent Application No. 2012-092851 filed Apr. 16, 2012, the contents of all of which are incorporated herein by reference in their entirety.

TECHNICAL FIELD

The present invention relates to a glow plug for a diesel engine.

BACKGROUND ART

Conventionally, as a glow plug for assisting starting of a diesel engine, or the like, a glow plug using a sheathed heater is known. The sheathed heater includes a metal tube (sheath tube) with a closed front end in which a heating coil is housed while enclosing an insulating powder such as MgO powder. As the materials of the heating coil, a Fe—Cr—Al alloy, a Ni—Cr alloy, and the like are known.

The Fe—Cr—Al alloy has a high melting point of 1520° C. On the other hand, the Ni—Cr alloy has a melting point of 1370° C., which is 150° C. lower than the Fe—Cr—Al alloy. Thus, the use of Ni—Cr alloy as the material of the heating coil may cause erosion of the heating coil at rapidly increasing temperatures. Hence, the Fe—Cr—Al alloy is commonly used as the material of the heating coil in the art. Furthermore, a control coil including Ni or Fe as a principal component and connected in series with a heating coil of Fe—Cr—Al alloy has been known as a structure that enables a rapid increase in temperature of the heating coil while preventing an excessive increase in temperature thereof (see, for example, Patent Document 1).

CITATION LIST

Patent Document

Patent Document 1: JP-A-2008-157485

SUMMARY OF INVENTION

Technical Problem

As described above, many of conventional glow plugs capable of rapidly increasing temperatures thereof are configured such that a heating coil of Fe—Cr—Al alloy and a control coil including Ni or Fe as a principal component are connected in series and housed in a sheath tube.

However, when a Fe—Cr—Al alloy is used in a heating coil, a gradual decrease in concentration of Al occurs with oxidation of Al in the heating coil and lowers the resistance value of the heating coil. Thus, a gradual increase in current flowing through the heating coil occurs, and evidently leads to deterioration and disconnection of the heating coil (hereinafter referred to as "deterioration/disconnection").

The present invention has been made in view of the above circumstances. An object of the present invention is to provide a glow plug that prevents a heating coil from being deteriorated and disconnected due to a decrease in resistance value caused by a decrease in the Al concentration in the heating coil, and also prevents the heating coil from being eroded due to an excessive increase in temperature at rapid increasing temperatures to extend the burn-out life of the heating coil.

Solution to Problem

According to an embodiment of the present invention, a glow plug includes a tubular metal shell extending in an axis direction; a heater including a metal tube with a closed front end and a coil housed in the tube, the tube being filled with an insulating powder and attached to the metal shell; and a center wire with a front end side connected to the coil in the tube, and with a rear end side protruding from a rear end of the tube. The coil includes a heating coil of an Ni—Cr alloy disposed on the front end side in the tube, and a control coil connected to a rear end side of the heating coil, and has a normal temperature resistance value of 300 mΩ to 500 mΩ. The accumulated amount of heat generated by the heating coil for two seconds from the start of energization is 400 joules or less. The ratio of an inrush current value at the start of energization to a current value two seconds after the start of energization (inrush current value/current value two seconds after the start of energization) is 1.2 or higher. The control coil has a temperature resistance coefficient of five or higher. The control coil has a resistance value of 25 mΩ or higher at a portion between a front end of the control coil and L/2, where L is the length of the control coil in the axis direction.

In the glow plug configured as described above according to the present invention, the use of a heating coil of a Ni—Cr alloy allows the heating coil to be prevented from being deteriorated and disconnected due to a decrease in resistance value caused by a decrease in the Al concentration in the heating coil. The coil of the heater includes the control coil connected in series with the rear end side of the heating coil, and has a normal temperature resistance value of 300 mΩ to 500 mΩ. The accumulated amount of heat generated by the heating coil for two seconds from the start of energization is 400 joules or less. The ratio of an inrush current value at the start of energization to a current value two seconds after the start of energization (inrush current value/current value two seconds after the start of energization) is 1.2 or higher. The control coil has a temperature resistance coefficient (resistance value at 1000° C./resistance value at 20° C.) of five or higher. The control coil has a resistance value of 25 mΩ or higher at a portion between the front end of the control coil and L/2. Such a configuration allows the heating coil to cause a rapid increase in temperature, achieving a temperature of approximately 1000° C. two seconds after the start of energization, and simultaneously allows the heating coil to be prevented from being eroded due to an excessive increase in temperature at rapid increasing temperatures. As a result, an increase in burn-out life can be achieved.

The reasons of setting the normal temperature resistance in the range of 300 mΩ to 500 mΩ are as follows: The normal temperature resistance has a large influence on the inrush current value. For example, if the normal temperature resistance is less than 300 mΩ when a voltage of 11 V is applied for two seconds, the inrush current value becomes too high and places an excessive load on the heating coil, causing erosion of the heating coil due to an excessive increase in temperature at rapid increasing temperatures. If the normal temperature resistance exceeds 500 mΩ, the inrush current value upon application of a voltage of 11 V becomes too small, and a rapid increase in temperature becomes difficult.

The accumulated amount of heat generated by the heating coil for two seconds from the start of energization is set to be 400 joules or less. This is because, if the accumulated amount of heat generated by the heating coil exceeds 400 joules, an excessive load is placed on the heating coil and the heating coil is eroded by an excessive increase in temperature at the time of a rapid increase in temperature. The present invention is predicated on a tube surface temperature of approximately 1000° C. or higher two seconds after the start of energization.

The current value ratio two seconds after the start of energization is set to be 1.2 or higher. This is because, if the ratio is less than 1.2, an increase in resistance value of the control coil does not occur at rapid increasing temperatures. Thus, an increase in load on the heating coil occurs, causing erosion of the heating coil due to an excessive increase in temperature at rapid increasing temperatures.

Further, the temperature resistance coefficient of the control coil is set to be five or higher. This is because, if the temperature resistance coefficient of the control coil is less than five, an increase in current value two seconds after the start of energization occurs. Thus, an increase in load on the heating coil occurs, causing erosion of the heating coil due to an excessive increase in temperature at rapid increasing temperatures.

The resistance value of the portion of the control coil between the front end of the control coil and L/2 is set to be 25 mΩ or higher. This is because, if the resistance value of the portion between the front end of the control coil and L/2 is less than 25 mΩ, an increase in current value two seconds after the start of energization occurs. Thus, an increase in load on the heating coil occurs, causing erosion of the heating coil due to an excessive increase in temperature at rapid increasing temperatures.

Preferably, in the glow plug configured as described above, the heater may have a resistance value per unit volume of 3.0 $m\Omega/mm^3$ to 5.0 $m\Omega/mm^3$ at a portion where the heating coil is present. This is because, if the resistance value per unit volume is less than 3.0 $m\Omega/mm^3$, there is a need of increasing the amount of heat generated by the heating coil per unit volume to heat the sheath (tube) surface to a predetermined temperature by a rapid increase in temperature, causing an increase in load on the heating coil. On the other hand, if the resistance value per unit volume exceeds 5.0 $m\Omega/mm^3$, the winding interval of the coil becomes excessively small and the adjacent coils are mutually influenced by their heat generation. Thus, an excessive increase in temperature of the heating coil occurs, causing an increase in load on the heating coil.

Preferably, in the glow plug configured as described above, the heating coil may include a wire material with a cross sectional area of 0.15 $mm^2$ to 0.30 $mm^2$.

The cross sectional area of the wire material of the heating coil is set to be 0.15 $mm^2$ to 0.30 $mm^2$ for the following reasons: Namely, if the cross sectional area of the wire material exceeds 0.30 $mm^2$, the winding interval of the coil becomes small, causing an increase in load on the heating coil. On the other hand, if the cross sectional area of the wire material is less than 0.15 $mm^2$, the load on the heating coil has to be increased so as to achieve a predetermined temperature of the sheath (tube) surface. Preferably, the cross sectional shape of the wire material in an arbitrary cross section including the heater central axis in an effective heating portion may be an ellipse having the major axis in the axis direction and the minor axis in a radial direction. Hence, the temperature of the sheath (tube) surface can be increased efficiently, enhancing rapid temperature rising property.

Advantageous Effects of Invention

The present invention provides a glow plug that prevents a heating coil from causing a decrease in resistance value due to a decrease in the Al concentration in the heating coil and also prevents the heating coil from being melted and disconnected due to an excessive increase in temperature at rapid increasing temperatures. Thus, the burn-out life can be extended.

DESCRIPTION OF EMBODIMENTS

In the following, the present invention will be described in detail by way of an embodiment with reference to the drawings.

Figure 1:
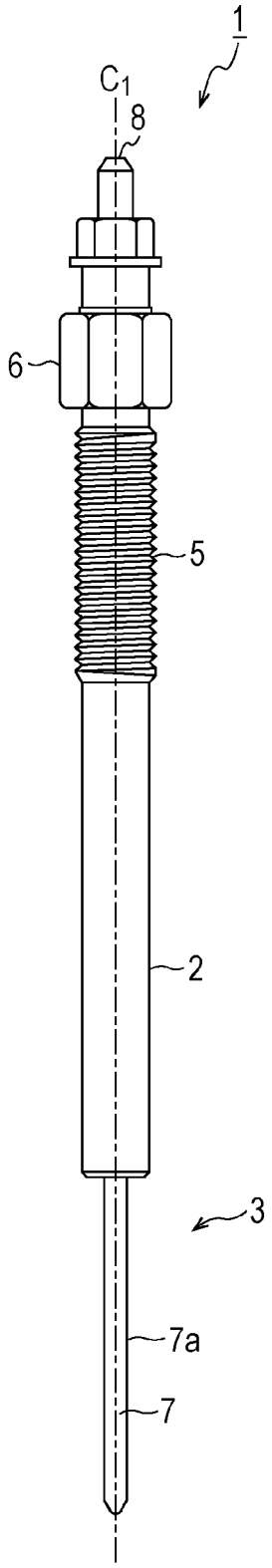
FIG. 1 is a diagram illustrating a schematic configuration of a glow plug according to an embodiment of the present invention.
Figure 2:
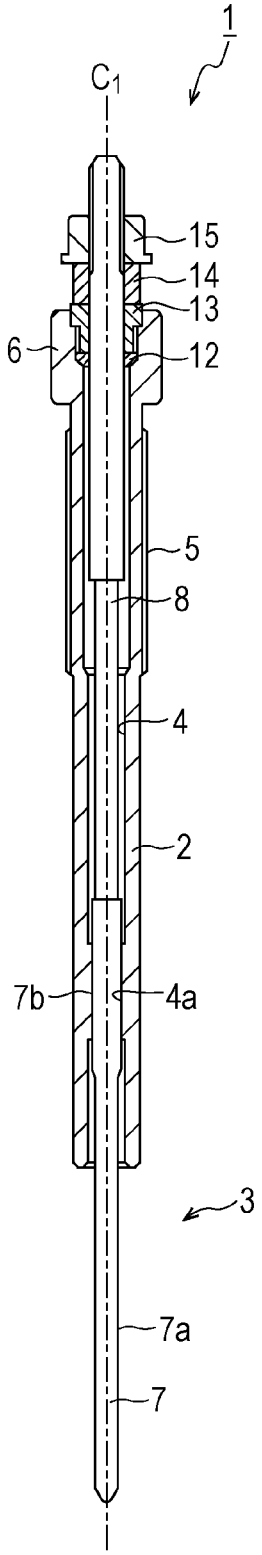
FIG. 2 is a diagram illustrating a cross-sectional schematic configuration of the glow plug of FIG. 1.
Figure 3:
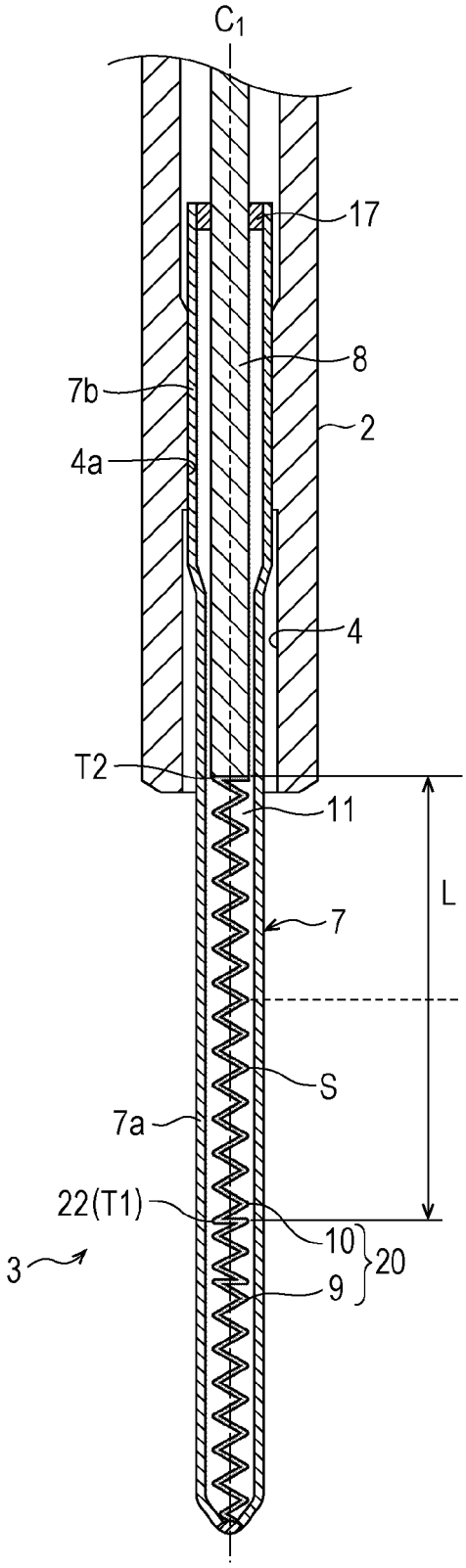
FIG. 3 is a diagram illustrating a cross-sectional schematic configuration of a main part of the glow plug of FIG. 1.

FIG. 1 is a diagram illustrating an overall schematic configuration of a glow plug 1 according to an embodiment of the present invention. FIG. 2 is a diagram illustrating a longitudinal cross-sectional schematic configuration of the glow plug 1. FIG. 3 is a diagram illustrating a longitudinal cross-sectional schematic configuration of a main part of the glow plug 1.

As illustrated in FIGS. 1 and 2, the glow plug 1 includes a tubular metal shell 2 and a sheathed heater 3 attached to the metal shell 2, and extends in the direction of an axis $C_1$.

The metal shell 2 has a shaft hole 4 penetrating in the direction of the axis $C_1$. The outer peripheral surface of the metal shell 2 is provided with a thread portion 5 for mounting on a diesel engine, and a tool engaging portion 6 with a hexagonal cross section for engagement with a tool, such as a torque wrench.

The sheathed heater 3 includes a sheath tube 7. As illustrated in FIG. 3, the sheath tube 7 is a cylindrical tube of a metal, such as a nickel base alloy, with a closed front end portion.

In the sheath tube 7, a coil 20 including a heating coil 9 joined to the front end of the sheath tube 7 and a control coil 10 connected in series with the rear end of the heating coil 9 is sealed, together with an insulating powder 11 of magnesium oxide (MgO) and the like. The sheath tube 7 and the heating coil 9 are joined at the front end portion.

Further, the rear end of the sheath tube 7 between the sheath tube 7 and the center wire 8 is sealed with annular rubber 17. While the heating coil 9 is in electrical conduction with the sheath tube 7 at the front end of the heating coil 9 as described above, the outer peripheral surfaces of the heating coil 9 and the control coil 10 are insulated from the inner peripheral surface of the sheath tube 7 by the interposed insulating powder 11.

The heating coil 9 includes, for example, a resistive heating wire of a nickel (Ni)-chromium (Cr) alloy. The control coil 10 includes a resistive heating wire of a material with a greater temperature coefficient of electrical resistivity than the temperature coefficient of electrical resistivity of the material of the heating coil 9, such as a cobalt (Co)-nickel (Ni)—Fe alloy with Co or Ni as a principal component. When energized, the heating coil 9 generates heat and increases the surface temperature of the sheath tube 7 up to a predetermined temperature. The control coil 10 makes an excessive increase in temperature in the heating coil 9 difficult. Thus, in the glow plug 1 according to the present embodiment, the use of the heating coil 9 of a Ni—Cr alloy allows the heating coil 9 to be prevented from being deteriorated and disconnected due to a decrease in resistance value caused by a decrease in the Al concentration in the heating coil.

The coil 20 constituting the heater, in which the control coil 10 is connected in series with the rear end of the heating coil 9, has a normal temperature resistance value of 300 mΩ to 500 mΩ, and is configured such that the accumulated amount of heat generated by the heating coil 9 for two seconds from the start of energization is 400 joules or less; the ratio of an inrush current value at the start of energization to a current value two seconds after the start of energization (inrush current value/current value two seconds after the start of energization) is 1.2 or higher; the temperature resistance coefficient of the control coil 10 (resistance value at 1000° C./resistance value at 20° C.) is five or higher; and the resistance value of a portion S between a front end T1 of the control coil 10 and L/2 is 25 mΩ or higher. The "length L in the direction of the axis $C_1$ of the control coil 10" refers to the length between the front end T1 of the control coil 10 welded to the heating coil 9 and a rear end T2 of the control coil 10 welded to the center wire 8, as illustrated in FIG. 3. The portion S, as illustrated in FIG. 3, refers to the portion between the front end of the control coil 10 and L/2 (in FIG. 3, the position of L/2 from the front end is indicated by a broken line). By adopting such a configuration of the heating coil 9 and the control coil 10, a rapid increase in temperature such that the temperature two seconds after the start of energization is approximately 1000° C. can be achieved, while the erosion of the heating coil 9 by an excessive increase in temperature at the time of the a rapid increase in temperature is prevented. As a result, an extended burn-out life can be achieved.

Preferably, the resistance value per unit volume of the sheathed heater 3 at the part where the heating coil 9 is present may be 3.0 mΩ/$mm^3$ to 5.0 mΩ/$mm^3$. Preferably, the cross sectional area of the wire material of the heating coil 9 may be 0.15 $mm^2$ to 0.30 $mm^2$. Further preferably, the cross sectional shape of the wire material of the heating coil 9 in a cross section including the central axis of the sheathed heater 3 in an effective heating portion may be an ellipse with the major axis aligned with the axis direction and the minor axis in a radial direction.

The sheath tube 7 includes a small diameter part 7*a* for housing the heating coil 9 and the like in the front end portion of the sheath tube 7, and a large diameter part 7*b* on the rear end side with a greater diameter than the diameter of the small diameter part 7*a*, which are formed by swaging and the like. As the large diameter part 7*b* is press-fitted in and joined with a small diameter part 4*a* of the shaft hole 4 of the metal shell 2, the sheath tube 7 is retained while protruding beyond the front end of the metal shell 2.

The center wire 8 is inserted into the shaft hole 4 of the metal shell 2, with the front end of the center wire 8 inserted into the sheath tube 7 and electrically connected to the rear end T2 of the control coil 10. The rear end of the center wire 8 protrudes beyond the rear end of the metal shell 2. At the rear end portion of the metal shell 2, an O-ring 12 of rubber and the like, an insulating bush 13 of a resin and the like, a pressing ring 14 for preventing the falling of the insulating bush 13, and a nut 15 for energization cable connection are fitted on the center wire 8 in the order mentioned (see FIG. 2).

Next, a method for manufacturing the glow plug 1 will be described. First, when the sheathed heater 3 is manufactured, a resistive heating wire of a Ni—Cr alloy is formed into a coil shape, obtaining the heating coil 9.

Then, a resistive heating wire of a Co—Ni—Fe-based alloy, for example, is formed into a coil shape, obtaining the control coil 10. The rear end portion of the heating coil 9 and the front end portion of the control coil 10 are joined at a joint portion 22 by arc welding and the like. Further, the center wire 8 is joined to the rear end side of the control coil 10 by arc welding and the like.

Meanwhile, a cylindrical tube material with a non-closed front end, i.e., an opening at the front end, and with a larger diameter than the final size by a processing margin is prepared. Then, the front end portion of the center wire 8 and the coil 20, which is integrated with the center wire 8 and which includes the heating coil 9 and the control coil 10, are disposed in the tube material.

Then, by performing arc welding and the like from the outside, the opening at the front end portion of the tube material is closed, and the front end portion of the tube material and the front end portion of the heating coil 9 are joined.

Thereafter, the tube material is filled with the insulating powder and then subjected to swaging processing. Thereby, the sheath tube 7 having the small diameter part 7*a* is formed and the sheath tube 7 is integrated with the center wire 8, thus completing the sheathed heater 3.

The sheathed heater 3 formed as described above is press-fitted and fixed in the shaft hole 4 of the metal shell 2, and the O-ring 12, the insulating bush 13 and the like are fitted on the center wire 8 at the rear end portion of the metal shell 2, whereby the glow plug 1 is completed.

Examples and comparative examples will be described. As illustrated in Table 1, glow plugs according to first to fifth examples and third to seventh comparative examples in which the material of the heating coil was an Ni—Cr alloy, and glow plugs according to first and second comparative examples in which the material of the heating coil was Fe—Cr—Al were manufactured. Table 1 shows various values of the glow plugs according to the first to fifth examples and the first to seventh comparative examples, including the normal temperature resistance value (mΩ) of the glow plug coil; the accumulated amount of heat (W) generated by the heating coil two seconds after the start of energization; the ratio of an inrush current value and a current value two seconds after the start of energization (inrush current/current after two seconds); the temperature resistance coefficient of the control coil; the resistance value (mΩ) of the portion of the control coil between the front end and L/2; the resistance value (mΩ/$mm^3$) per unit volume of the portion of the heater where the heating coil is present; and the cross sectional area ($mm^2$) of the effective heating portion of the wire material of the heating coil. The measurement for the first to fifth examples and the first to seventh comparative examples shown in Table 1 was conducted as follows.

The normal temperature resistance value was obtained by measuring the resistance value of the glow plug at normal temperature (25° C.).

The accumulated amount of heat generated by the heating coil was obtained by constantly measuring the current value between the inrush and two seconds later while the glow plug was energized, and by measuring the accumulation according to $W=RI^2$ (the resistance value R of the heating coil was calculated by confirming the temperature of the heating coil by a thermocouple spark plug and by multiplying the temperature with the temperature resistance coefficient of the heating coil).

The current value ratio two seconds after the start of energization (inrush current/current after two seconds) was determined by measuring the inrush current value and the current value two seconds later when energized such that the temperature reached approximately 1000° C. two seconds after the start of energization.

The resistance value of the portion of the control coil between its front end and L/2 was measured by a resistance measuring machine with terminals contacted with the front end of the control coil and the portion at L/2, with the sheath tube 7 of the glow plug detached.

The unit resistance value was calculated from the volume of the sheath tube corresponding to the heating coil portion (including the thickness of the sheath tube) and the resistance value of the heating coil.

TABLE 1

| | Heating coil material | Normal temperature resistance value | Accumulated amount of heat generated by heating coil | Inrush current/current after two seconds | Temperature resistance coefficient of control coil | Resistance value of portion of control coil between its front end and L/2 | Resistance value per unit volume | Cross sectional area |
|---|---|---|---|---|---|---|---|---|
| First Example | Ni—Cr | 375 | 360 | 1.36 | 6.00 | 29 | 4.10 | 0.17 |
| Second Example | Ni—Cr | 422 | 375 | 1.33 | 6.00 | 27 | 4.90 | 0.09 |
| Third Example | Ni—Cr | 370 | 390 | 1.33 | 6.00 | 28 | 3.10 | 0.35 |
| Fourth Example | Ni—Cr | 366 | 388 | 1.40 | 6.00 | 25 | 2.50 | 0.23 |
| Fifth Example | Ni—Cr | 375 | 390 | 1.22 | 6.00 | 30 | 6.00 | 0.15 |
| First Comparative Example | Fe—Cl—Al | 478 | 430 | 1.11 | 6.00 | 22 | 4.20 | 0.16 |
| Second Comparative Example | Fe—Cl—Al | 350 | 400 | 1.36 | 6.00 | 25 | 3.80 | 0.18 |
| Third Comparative Example | Ni—Cr | 250 | 400 | 1.42 | 6.00 | 26 | 3.20 | 0.18 |
| Fourth Comparative Example | Ni—Cr | 551 | 350 | 1.25 | 6.00 | 29 | 3.30 | 0.15 |
| Fifth Comparative Example | Ni—Cr | 355 | 425 | 1.17 | 6.00 | 17 | 3.50 | 0.19 |
| Sixth Comparative Example | Ni—Cr | 400 | 450 | 1.08 | 2.00 | 24 | 3.20 | 0.18 |
| Seventh Comparative Example | Ni—Cr | 400 | 418 | 1.18 | 6.00 | 16 | 3.30 | 0.18 |

The first to fifth examples and the first to seventh comparative examples were tested and evaluated for resistance value drop, rapid temperature rising property, and burn-out life. The results of the evaluation are shown in Table 2.

TABLE 2

| | Resistance value drop | Rapid temperature rising property | Burn-out life |
|---|---|---|---|
| First Example | ○ | ⊙ | ⊙ |
| Second Example | ○ | ⊙ | ○ |
| Third Example | ○ | ⊙ | ○ |
| Fourth Example | ○ | ○ | ○ |
| Fifth Example | ○ | ○ | ○ |
| First Comparative Example | X | ○ | X |
| Second Comparative Example | X | ○ | X |
| Third Comparative Example | ○ | X | — |
| Fourth Comparative Example | ○ | X | — |
| Fifth Comparative Example | ○ | X | — |
| Sixth Comparative Example | ○ | X | — |
| Seventh Comparative Example | ○ | X | — |

For the resistance value drop, the testing and evaluation were conducted as follows. A theoretical durability test, each cycle of which consisting of the starting of energization; a two-second interval (sheath tube temperature 1000° C.); energization continued with the existing current value; saturation temperature 1100° C. for 180 seconds; and cooling for 120 seconds, was conducted for 2000 cycles. A decrease in normal temperature resistance value of less than 5% with respect to the initial normal temperature resistance value was considered ○, and a decrease of 5% or more was considered x.

For the rapid temperature rising property, the testing and evaluation were conducted as follows. The determination was made on the basis of the initial energization to the glow plug. The temperature was measured at a position 2 mm from the front end of the tube by using a thermocouple and the like.

When the temperature two seconds after the application of a voltage of 11 V was 950° C. or higher and 1050° C. or less, the result was considered ⊙.

When the temperature two seconds after the application of the voltage of 11 V was 900° C. or higher and less than 950° C., or higher than 1050° C. and 1100° C. or less, the result was considered ○.

When the temperature two seconds after the application of the voltage of 11 V was less than 900° C. or higher than 1100° C., the result was considered x.

For the burn-out life, the same theoretical durability test as for the resistance value drop was conducted, and the evaluation was made as follows. The burn-out life was not evaluated for the glow plugs for which the predetermined evaluation of the rapid temperature rising property was x.

Number of disconnection cycles was 8000 or higher: ⊙

Number of disconnection cycles was 5000 or higher and less than 8000: ○

Number of disconnection cycles was less than 5000: x

As indicated by the evaluation results shown in Table 2, in the case of the glow plugs according to the first and second comparative examples in which the heating coil material was Fe—Cr—Al, a resistance value drop of 5% or higher arose after energization was repeatedly conducted. On the other hand, in the case of the glow plugs according to the first to fifth examples and the first to seventh comparative examples in which the heating coil material was Ni—Cr, the resistance value drop was less than 5%.

Further, good results were obtained in both rapid temperature rising property and burn-out life in the first to fifth examples in which the normal temperature resistance value was 300 mΩ to 500 mΩ; the accumulated amount of heat generated by the heating coil for two seconds from the start of energization was 400 joules or less; the ratio of the inrush current value to the current value two seconds after the start of energization (inrush current/current after two seconds) was 1.2 or higher; and the temperature resistance coefficient of the control coil was five or higher.

The rapid temperature rising property was even better in the first to third examples in which the resistance value per unit volume in the portion where the heating coil exists was 3.0 mΩ/mm$^3$ to 5.0 mΩ/mm$^3$. Further, of the first to third examples, the burn-out life was even better in the first example in which the cross sectional area of the heating coil wire material was in the range of 0.15 mm$^2$ to 0.30 mm$^2$.

On the other hand, the rapid temperature rising property was not satisfied in the third comparative example in which the normal temperature resistance value was less than 300 mΩ; the fourth comparative example in which the normal temperature resistance value was higher than 500 mΩ; the fifth to seventh comparative examples in which the accumulated amount of heat generated for two seconds from the start of energization was higher than 400 joules; the fifth to seventh comparative examples in which the current value ratio two seconds after the start of energization (inrush current/current after two seconds) was less than 1.2; the sixth comparative example in which the temperature resistance coefficient of the control coil was less than five; and the fifth and seventh comparative examples in which the resistance value of the portion of the control coil between its front end and L/2 was less than 25 mΩ.

In the third comparative example, the fifth comparative example, the sixth comparative example, and the seventh comparative example, the temperature two seconds after the application of the voltage of 11 V exceeded 1100° C. When the temperature exceeds 1100° C. two seconds after the application of the voltage of 11 V, the load on the heating coil becomes large and the heating coil is eroded by an excessive increase in temperature at the time of a rapid increase in temperature. Meanwhile, in the fourth comparative example, the temperature two seconds after the application of the voltage of 11 V was less than 900° C. When the temperature two seconds after the application of the voltage of 11 V is less than 900° C., a rapid increase in temperature is difficult.

In the first and second comparative examples in which the heating coil material was Fe—Cr—Al, the burn-out life was not satisfied. This is due to the fact that, as Al in the heating coil is oxidized, the Al concentration gradually decreases and the resistance value of the heating coil is decreased. As a result, the current that flows through the heating coil gradually increases, causing the heating coil to be disconnected by deterioration and making the burn-out life shorter.

While the details of the present invention have been described by way of an embodiment and examples, it goes without saying that the present invention is not limited to the embodiment or the examples, and various modifications are possible.

REFERENCE SIGNS LIST

1 Glow plug
2 Metal shell
3 Sheathed heater
7 Sheath tube (tube)
8 Center wire
9 Heating coil
10 Control coil
20 Coil

The invention claimed is:

1. A glow plug comprising:

a tubular metal shell extending in an axis direction;

a heater including a metal tube with a closed front end and a coil housed in the tube, the tube being filled with an insulating powder and attached to the metal shell; and a center wire with a front end side connected to the coil in the tube, and with a rear end side protruding from a rear end of the tube, wherein the coil includes a heating coil of an Ni—Cr alloy disposed on the front end side in the tube, and a control coil connected to a rear end side of the heating coil, and has a normal temperature resistance value of 300 mΩ to 500 mΩ, the accumulated amount of heat generated by the heating coil for two seconds from the start of energization is 400 joules or less, the ratio of an inrush current value at the start of energization and a current value two seconds after the start of energization (inrush current value/current value two seconds after the start of energization) is 1.2 or higher, the control coil has a temperature resistance coefficient of five or higher, and the control coil has a resistance value of 25 mΩ or higher at a portion between a front end of the control coil and L/2, where L is the length of the control coil in the axis direction.

2. The glow plug according to claim 1, wherein the heater has a resistance value per unit volume of 3.0 $m\Omega/mm^3$ to 5.0 $m\Omega/mm^3$ at a portion where the heating coil of the heater is present.

3. The glow plug according to claim 1, wherein the heating coil includes a wire material with a cross sectional area of 0.15 $mm^2$ to 0.30 $mm^2$.

4. The glow plug according to claim 2, wherein the heating coil includes a wire material with a cross sectional area of 0.15 $mm^2$ to 0.30 $mm^2$.

* * * * *